US006069456A

United States Patent [19]

Fromm et al.

[11] Patent Number: 6,069,456

[45] Date of Patent: May 30, 2000

[54] MERCURY-FREE METAL HALIDE LAMP

[75] Inventors: Dietrich Fromm, Warngau; Dieter Lang, Bruckmuehl; Klaus Stockwald, Munich, all of Germany

[73] Assignee: Osram Sylvania Inc., Danvers, Mass.

[21] Appl. No.: 09/118,491

[22] Filed: Jul. 17, 1998

[30] Foreign Application Priority Data

Jul. 21, 1997 [DE] Germany ..... 197 31 168

[51] Int. Cl.[7] ..... H05B 41/16

[52] U.S. Cl. ..... 315/248; 315/246; 315/363; 313/637

[58] Field of Search ..... 315/246, 358, 315/307, 248; 313/637, 638, 343, 570, 623

[56] References Cited

U.S. PATENT DOCUMENTS

| | | | |
|---|---|---|---|
| 4,291,254 | 9/1981 | Arlt et al. | 315/240 |
| 4,373,146 | 2/1983 | Bonazoli et al. | 315/209 R |
| 4,647,821 | 3/1987 | Lapatovich et al. | 315/248 |
| 5,323,090 | 6/1994 | Lestician | 315/291 |
| 5,363,007 | 11/1994 | Fromm et al. | 313/25 |
| 5,491,387 | 2/1996 | Saito | 315/307 |
| 5,637,960 | 6/1997 | Juengst et al. | 313/625 |
| 5,729,091 | 3/1998 | Barthelmes et al. | 313/638 |
| 5,844,365 | 12/1998 | Natour | 313/633 |
| 5,854,535 | 12/1998 | Hohlfeld et al. | 313/636 |

FOREIGN PATENT DOCUMENTS

| | | | |
|---|---|---|---|
| 0507533 | 10/1992 | European Pat. Off. | H01J 65/00 |
| 0627759 | 12/1994 | European Pat. Off. | H01J 61/12 |
| 0673183 | 9/1995 | European Pat. Off. | H05B 41/392 |
| 2707204 | 7/1983 | Germany | H01J 61/18 |
| 4035561 | 12/1994 | Germany | H01J 61/22 |

*Primary Examiner*—Don Wong
*Assistant Examiner*—Tuyet T. Vo
*Attorney, Agent, or Firm*—William H. McNeil

[57] ABSTRACT

Lighting system, comprising a mercury-free metal halide lamp with a light yield of at least 75 lm/W and a color rendition index of at least 75 and an electronic ballast, the electronic ballast impressing a square-wave power supply on the lamp and keeping the power constant. The filling comprises the following components:

a buffer gas which also acts as starting gas to start the lamp, a voltage gradient generator, comprising at least one metal halide which vaporizes readily and which is chiefly (by more than 50%) responsible for generating a voltage gradient which corresponds approximately to that of mercury, and a light generator comprising one metal and/or one metal halide.

25 Claims, 10 Drawing Sheets

MERCURY-FREE METAL HALIDE LAMP

TECHNICAL FIELD

The invention proceeds from a lighting system in accordance with the preamble of Claim 1, comprising a lamp and ballast. In this case, it is metal halide lamps with a ceramic discharge vessel which are used, in particular, as the lamps.

PRIOR ART

To date, use has mostly been made of mercury (Hg) as buffer gas for providing specific properties in metal halide lamps:

1. Owing to the large elastic impact cross-section for electrons, mercury serves for setting the operating voltage or the voltage gradient (=operating voltage/electrode spacing) of the plasma arc.

2. The relatively low thermal conductivity and relatively high viscosity of mercury vapour improves the formation of isothermal wall temperatures of the discharge vessel.

3. The high vapour pressure of mercury renders it possible to dose and set the electric and thermal properties of high-pressure lamps effectively.

4. The inert metal character of mercury facilitates reversible back formation of the Hg and other reactive gaseous substances (halides) during cooling of the lamp (metal in excess in liquid form, formation of Hg halides).

In the current prior art, 25–200 $\mu$mol/cm$^3$ (5–40 mg/cm$^3$) Hg is typically filled into metal halide lamps with a ceramic discharge vessel for the purpose of setting the operating voltage, depending on the electrode spacing and the metal halide filling used.

However, mercury is increasingly being viewed as an environmentally harmful and poisonous substance which is to be avoided as far as possible in modern mass production because of the risk posed to the environment by its use, production and disposal. Consequently, attempts are increasingly being made to develop mercury-free high-pressure discharge lamps.

DE-C 40 35 561 has already disclosed a metal halide lamp with a ceramic discharge vessel whose mercury-free filling contains inert gas (xenon) and a halide of lithium (or of Na, Tl, In) for generating an arc discharge. Furthermore, the filling contains a substance which forms a halide complex, for example a halide of aluminium or tin, which forms complexes with the halides of sodium or lithium.

DE-C 27 07 204 has disclosed a mercury-free filling with inert gases and metal halides which contains thallium, one or two rare earth metals (Dy, Ho) and/or an alkali metal (Na, Cs) as well as possibly indium.

These publications specify neither a colour rendition nor a light yield. Our own measurements have shown that under the specified operating conditions the above fillings reach at most a colour rendition of Ra=60 and a light yield of 60 lm/W.

EP-B 627 759 has disclosed a metal halide lamp of high light yield which uses mercury as buffer gas. An exemplary embodiment also exhibits a mercury-free filling for daylight use with a colour temperature of 5350 K employing $HfBr_4$ as metal halide, as well as an addition of elementary tin. In this case, the xenon (cold filling pressure 1 bar) takes over the role of buffer gas. However, these lamps have enormous restarting peaks of approximately 600 V, and can therefore be operated only using complicated circuit engineering.

On the other hand, fillings which are Hg-low or virtually mercury-free are predominantly used for electrodeless metal halide high-pressure lamps, since the injection of the electric energy via electromagnetic waves decreases with increasing Hg density and is screened in outer plasma layers. In these cases of metal halide lamps, as well, it is predominantly xenon (Xe) or other inert gases which are used as buffer gases, or Hg is filled in very small quantities (<1 mg/cm$^3$, "essentially mercury-free"). However, this technique is very expensive and unsuitable for lamps of low power (below 250 W), since the light yield is then drastically reduced.

DESCRIPTION OF THE INVENTION

It is the object of the present invention to provide a lighting system in accordance with the preamble of claim 1 whose mercury-free filling attains properties which are equivalent to those of mercury-containing metal halide lamps. The simultaneous attainment of a colour rendition index of at least Ra=75 and a light yield of at least 75 lm/W is regarded in this case as essential properties.

This object is achieved by means of the characterizing features of claim 1. Particularly advantageous embodiments are to be found in the dependent claims.

The basic object requires a substitute substance or a mixture of substitute substances for Hg in high-pressure lamps and at the same largely maintaining the lighting engineering and electrical properties of the typical metal halide high-pressure lamp.

It is also essential for the invention to preserve the tried and tested technology which uses electrodes so that it is also possible to realize low powers.

In this case, the discharge vessel can consist of silica glass, as is known per se. However, particular preference goes to a discharge vessel made from ceramic, transparent or translucent material which can be subjected to high thermal loads. This material can consist of monocrystalline metal oxide (for example sapphire), polycrystalline sintered metal oxide (for example: PCA: polycrystalline, densely sintered aluminium oxide, yttrium aluminium garnet or yttrium oxide) or of polycrystalline non-oxidative material (for example AlN).

It is chiefly Xe which, as the heaviest of the stable inert gases, is used in the literature as substitute for Hg as buffer gas. In the case of the use of discharge vessels made from quartz or silica glass, it can be filled by being frozen, with the result that the lamp filling contains a buffer gas at overpressure. In the case of the use of ceramic bodies as discharge vessel, this filling method can lead to cracks along the discharge vessel because of the high temperature gradient produced, and can therefore be applied only with a high outlay and at high risk.

At any rate, xenon as buffer gas supplies only a slight contribution (10 to 20%) to the voltage gradient in the lamp.

A particularly preferred embodiment of the invention is a mercury-free metal halide lamp with electrodes which has a ceramic discharge vessel in an evacuated outer bulb made from silica glass or hard glass with a high light yield (typically>80 lm/W) and a high colour rendition index (typically Ra>80).

Using the filling substances according to the invention, it is preferably possible to realize the range of warm white to neutral white colour temperatures (typically 3000–4500 K). However, it is also possible under certain circumstances to attain daylight-white colour temperatures (around 5300 K) with a high Ra (approximately 90).

According to the invention, use is made of the following filling components with special functions for lamp operation:

1. Inert gas (Ne, Ar, Kr, Xe or mixtures thereof) is used as starting gas for starting the lamps, and simultaneously as buffer gas. The minimum filling pressure (cold) is 1 mb. The typical pressure range is a few mbar to 1 bar. Using special sealing technologies (laser welding of lead-throughs made from Cermet), it is even possible in the case of the use of a ceramic discharge vessel to use the inert gas as buffer gas with a cold filling pressure of more than 1 bar.

2. Use is made as voltage gradient generator of at least one metal halide with a high electron impact cross-section, which achieves a substantial vapour pressure (preferably at least 0.5 bar) during operation of the lamp (given a wall temperature of the discharge vessel of approximately 900 to 1100° C., it being possible for the cold spot temperature to be much lower). The point is that the voltage gradient is determined chiefly by these two factors. According to the invention, these metal halides are chiefly (with a proportion of at least 50%) to determine the voltage gradient in the discharge arc. This metal halide is essentially a substitute substance for Hg with regard to the fact that it covers the partial aspect of setting the voltage gradient.

3. The filling also contains at least one light generator which chiefly contributes to the light generation. Metal halides are preferred, it also being possible to use metals in addition.

Here, and in what follows, iodine, bromine or chlorine, but not fluorine are meant by the term halogen. A corresponding statement holds for halides.

Appropriate vapour pressure curves are found, for example, in the tables of Landolt-Börnstein "Gleichgewichte Dampf-Kondensat und osmotische Phänomene" ["Vapour-condensate equilibria and osmotic phenomena"], Springer-Verlag Heidelberg, 1960. In the representation $$P=10^{(A/T+B)}$$

(where P=vapour pressure in atm, T=temperature in kelvins), A and B are constants, said constants being specified below for some metal halides of importance here:

TABLE 1

| Metal halides | Constant A | Constant B |
|---|---|---|
| $AlBr_3$ | −2666 | 5,038 |
| $AlI_3$ | −3768 | 5,758 |
| $HfBr_4$ | −5257 | 8,816 |
| InBr | −5017 | 5,301 |
| InI | −5384 | 5,387 |
| $MgI_2$ | −11136 | 10,470 |
| $ZnI_2$ | −5629 | 5,596 |

It is to be borne in mind here that the above relationship plays a decisive role chiefly in the starting phase, at relatively low temperatures, as well as during saturated operation, in which a sediment remains. Some of the metal halides, chiefly the voltage gradient generators, can also preferably be operated in an unsaturated fashion.

In the case of some filling compositions, it is advantageous to use first additional additives, preferably metal halides, to improve the electric lamp properties and to influence the arc temperature profile. Particularly suitable for this purpose are metals or metal compounds whose excitation or ionization energies are in the range of the abovementioned metal halides, and are preferably below that.

Moreover, further second additives, preferably elementary metals, can be added to the filling, which reduce the restarting peaks by acting as getters for free electronegative gas fractions. Their halides have lower formation enthalpies than metal compounds, which can possibly form from the material of the electrodes and that of the supply leads (W, Mo) located in the lamp. They serve essentially to prolong the service life of the lamps, and support an effective, stable chemical cyclic process. They are mostly elementary metals which are present in excess of the halides of said metals, which have already been filled in, in particular aluminium, tin and magnesium. Good results have also been attained with elementary tantalum. The maximum dosage of these metals is in each case 10 mg/cm$^3$.

Discharge vessels made from silica glass can be used in principle for the present invention. However, preference goes to lamps with a ceramic vessel, which permit substantially higher wall temperatures. Thus, it is possible to set a much higher total pressure and partial vapour pressure, as well as a higher particle density of the substances used to generate light. Moreover, the conditions for the possibility of the formation of metal halide complexes and the possibility of forming supersaturated metal vapours for forming metal atom clusters are improved by the increase in the wall temperature.

In detail, the following filling components are used, the lamps predominantly being operated in an unsaturated fashion, at least with reference to partial components:

1. Starting gases: Ne, Ar, Kr, Xe and mixtures thereof. Said gases can also serve as buffer gas. Typical filled quantities are 10–500 mbar (cold filling pressure); a range of 50–300 mb is particularly preferred.

2. Halides (preferably bromides and/or iodides) of the following metals are suitable as voltage gradient generators: Al, Bi, Hf, In, Mg, Sc, Sb, Sn, Tl, Zn, Zr, Ga. They can be used individually or as a mixture (compare Table 2). Typical filled quantities are:

1–200 $\mu$mol/cm$^3$. In particularly preferred embodiments, the proportion of trivalent metal halides (for example Al halides) is 5–50 $\mu$mol/cm$^3$, that of tetravalent metal halides (for example Hf halides) is 2–20 $\mu$mol/cm$^3$, and that of mono- to divalent metal halides (for example In halides, preferably $ZnI_2$) is 1–100 $\mu$mol/cm$^3$. Moreover, elementary Zn is also suitable as voltage gradient generator, chiefly as an additive to a further metal halide. The operating voltage can thereby be set very effectively approximately to the value in the case of an Hg-containing filling (approximately 75 to 110 V/cm).

3. The halides (preferably bromides, iodides) of the following metals are suitable as light generators with a principle contribution to light generation and setting the colour temperature and colour rendition: Na, Pr, Nd, Ce, La, Tm, Dy, Ho, Tl , Sc, Hf, Zr. They can be used individually or as a mixture (compare Table 3). Their dosage is typically 1–30 mg/cm$^3$. In this case, a substantially higher (approximately 5 to 10 times higher) dosage (typically 15 to 30 mg/cm$^3$) is indicated for ceramic discharge vessels with a high dead volume (capillary tube technology using glass solder) than for ceramic discharge vessels using sintering sealing technology or for silica glass vessels (typically 3 to 10 mg/cm$^3$). A special example is a six-component mixture $TlI/DyI_3/TmI_3/HoI_3/CeI_3/CsI$ (5 mg) in a lamp volume of 0.3 cm$^3$, resulting in a specific quantity of 17 mg/cm$^3$ using capillary technology.

4. Metal halides of cesium are suitable as first additional additive with a strong influence on the temperature profile of the arc column. If sodium is lacking as light generator, it is also possible to (co)use lithium.

5. A typical dosage of 0.5 to 10 mg/cm$^3$ is used for the elementary metal additives which can serve as second additives. An addition of Al (approximately 1 mg/cm$^3$) or Sn (approximately 1 mg/cm$^3$) or In (approximately 3 mg/cm$^3$) is recommended, in particular.

The ratio of the total mole quantity of all metals filled in to the total mole quantity of all the halogens filled in is preferably between 0.1 and 10.

It is also possible in addition to use oxygen getters (such as, for example: SnP) to suppress the electrode corrosion by the increased formation of $WOX_2$ (X=halogen).

A decisive breakthrough in the efforts to create a competitive mercury-free metal halide lamp was achieved by carefully analysing and optimizing the mode of operation for such lamps. This aspect has been completely neglected to date in the development of mercury-free metal halide high-pressure lamps.

No restarting voltage peak occurs in the case of the previously known mercury-containing metal halide lamps (even in the case of 50 Hz operation), since mercury is the main voltage gradient generator. The quantity of free halogen in the discharge vessel is so low that the halogen captures virtually no free charge carriers. The discharge plasma therefore does not decompose quickly. By contrast, it has proved in the case of lamps with a filling according to the invention that it is possible for high restarting voltage peaks to occur in conventional sinusoidal operation at 50 Hz which lead to premature quenching of the discharge in the case of lamps according to the invention. The reason for this is that the mercury is replaced by a metal halide component. The halogen fraction in the discharge vessel is then relatively high. Free charge carriers are very quickly captured by halogens, with the result that the plasma decomposes very quickly. For this reason, a conventional ballast is less well suited for operating the lamps according to the invention.

The operation of lamps using AC voltage is performed according to the invention such that the rate of change in the lamp voltage (seen in absolute terms, it is a question of a voltage rise in the negative or positive direction) proceeds so quickly during the polarity reversal that restarting peaks in the temporal characteristic of the lamp voltage are greatly reduced. The lamp is thereby reliably prevented from being extinguished. These restarting peaks are produced by the quenching of the discharge arc in the case of polarity reversal, and by the cooling of the electrodes.

The level of the still acceptable restarting peak is determined, on the one hand, by the idling voltage, that is to say the maximum achievable supply voltage, and, on the other hand, by the response voltage of a starting device which is located in the voltage path and generates starting pulses at the lamp voltage, starting from when a specific voltage level (precisely the response voltage) is exceeded. A defective mode of operation with an excessively high restarting peak leads to overloading of the starting device and shortens its service life.

At the edges (that is to say in the region of greatest voltage change), the rate of voltage change in the lamp voltage, which is defined as the absolute value of the voltage change divided by the duration of the voltage change (for which reason it is often designated below for simplicity as the rate of voltage rise), should be at least 0.3 V/$\mu$s, in particular preferably at least 1 V/$\mu$s. Good results are achieved with approximately 3 V/$\mu$s. An adequate rate of voltage rise can be realized in principle by means of a relatively high-frequency sinusoidal AC voltage (at least 1 kHz, preferably more than 250 kHz). In principle, other similar voltage shapes (for example a saw-tooth shape) with a comparable duration of the half period are also suitable.

The use of conventional starting devices is basically possible. In this case, the response voltage is (given the use of a sinusoidal voltage) 200 $V_{eff}$(=282 $V_{pk}$), corresponding to approximately 85% of the idling voltage (or supply voltage). It is assumed below as an example that said voltage corresponds to the usual mains voltage of 230 $V_{eff}$. Of course, it is also possible to use a medium-voltage mains voltage (approximately 110 $V_{eff}$) by analogy. Acceptable restarting peaks in the lamp voltage (of main interest here is the peak voltage and less the root-mean-square value of the voltage) must be substantially below the response voltage. A value of approximately 75% of the idling voltage is therefore acceptable for the restarting peak. For 230 $V_{eff}$, for example, this yields a value of 173 $V_{eff}$, that is to say a peak voltage of 244 $V_{pk}$.

Operating on an electronic ballast with square-wave current injection is particularly preferred, since said pulse shape ensures steep edges from the start. A frequency of 50 Hz therefore already suffices in principle in order to set the rate of voltage rise to the region of over 0.3 V/$\mu$s set forth above in the case of polarity reversal. The reason for this is the steepness of the square-wave edges. However, it is also possible to operate at a higher frequency (for example 120 Hz or more). A duration of at most approximately 400 $\mu$s for the voltage rise is advantageous, and said duration is less than 100 $\mu$s in a particularly preferred embodiment. A value of approximately 10 to 50 $\mu$s is very well suited.

A suitable electronic ballast is already known in principle, for example from U.S. Pat. No. 4,291,254 or DE-A 44 00 093, both of which are explicitly referred to. However, it is chiefly the aspect of the light yield increased by the high operating frequency (up to 8%) which is considered there.

A particular advantage of square-wave operation is that the foundation for a stable continuous operation without acoustic resonances is thereby created. In principle, a high-frequency sinusoidal excitation is also possible if operation is performed at frequencies of >1 kHz with sinusoidal voltage edges, the timescale thereof typically corresponding to the steep edges in the case of square-wave operation (order of magnitude of 10 to 100 $\mu$s). A high frequency (>250 kHz) is advantageous particularly during starting because of the risk of acoustic resonances. It is important in this case that the rate of voltage rise (in V/$\mu$s) is set in such a way that restarting peaks which are impressed on the operating voltage of the lamp are suppressed as far as possible. Stable operation is then possible in the case of sinusoidal AC voltage as well.

A further advantageous aspect of square-wave current operation is, furthermore, that the power of the lamp can be kept constant in operation at a few percent (constant-wattage operation). In this case, the lamp should already be fed at least 50% (preferably more than 60%) of the nominal power in the first minutes during starting. Use is therefore advantageously made of electronic ballasts having square-wave operation, by means of which it is possible to realize constant-wattage operation and the occurrence of high restarting peaks is reliably avoided. A circuit for operating a high-pressure discharge lamp at constant power is disclosed, in principle, in EP-A 680 245, for example.

The particular problems in constructing mercury-free lamps are to be explained in more detail by the following consideration.

Earlier attempts using mercury-free discharge lamps were based on a Xe discharge of a few bars pressure using a rare-earth halide additive as light generator. Xenon is the exclusive voltage gradient generator here. Despite the high xenon pressure, the operating voltage of said lamps is, however, only at approximately 35 V (corresponding approximately to 40% of the value for mercury of approximately 87 V). The lamp power required to vaporize the halides must therefore be ensured by injecting a correspondingly high current. This requires very massive electrodes, in turn, which makes starting and arc takeover difficult in the case of said lamps.

By contrast, the approach to a solution according to the invention now consists in primarily using iodides or bromides of readily vaporizable metals instead of xenon, in order to generate a voltage gradient comparable to that of Hg. Alone or in combination, bromine and iodine (atomic or molecular) have a large effective cross-sectional area for electron capture. The result is to step up the operating voltage of a lamp to the accompaniment of the formation of negative ions or molecules.

The concept of the voltage gradient generator can be modified to the effect that it is not the metal halides alone which take over said function, but a certain contribution to the voltage gradient (up to 40%) is made by a correspondingly high xenon pressure (more than 500 mb cold filling pressure). This permits good tuning with regard to filling systems which are as simple as possible and in which a portion of the metal halides used as voltage gradient generators also functions as light generators, for example halides of Al, In, Mg and, above all, Tl. It is an advantage of this concept that during starting with a high starting current (typically 2 A) the electrodes are protected against excessively strong overheating when xenon acts as starting gas and gradient generator.

The use of a low voltage gradient of less than 45 V/cm should be avoided as far as possible for reasons of lamp technology, because the high current necessary in this case requires relatively thick electrodes, which can then trigger harmful effects on the arc tube wall because of their proximity to it. In addition, in the case of very massive electrodes the cold-starting properties worsen, with the negative consequence of more atomization of electrode material, which leads to premature blackening of the wall of the discharge vessel.

FIGURES

The invention is to be explained in more detail below with the aid of a plurality of exemplary embodiments. In the drawings.

DESCRIPTION OF THE PREFERRED EMBODIMENTS

Figure 1:
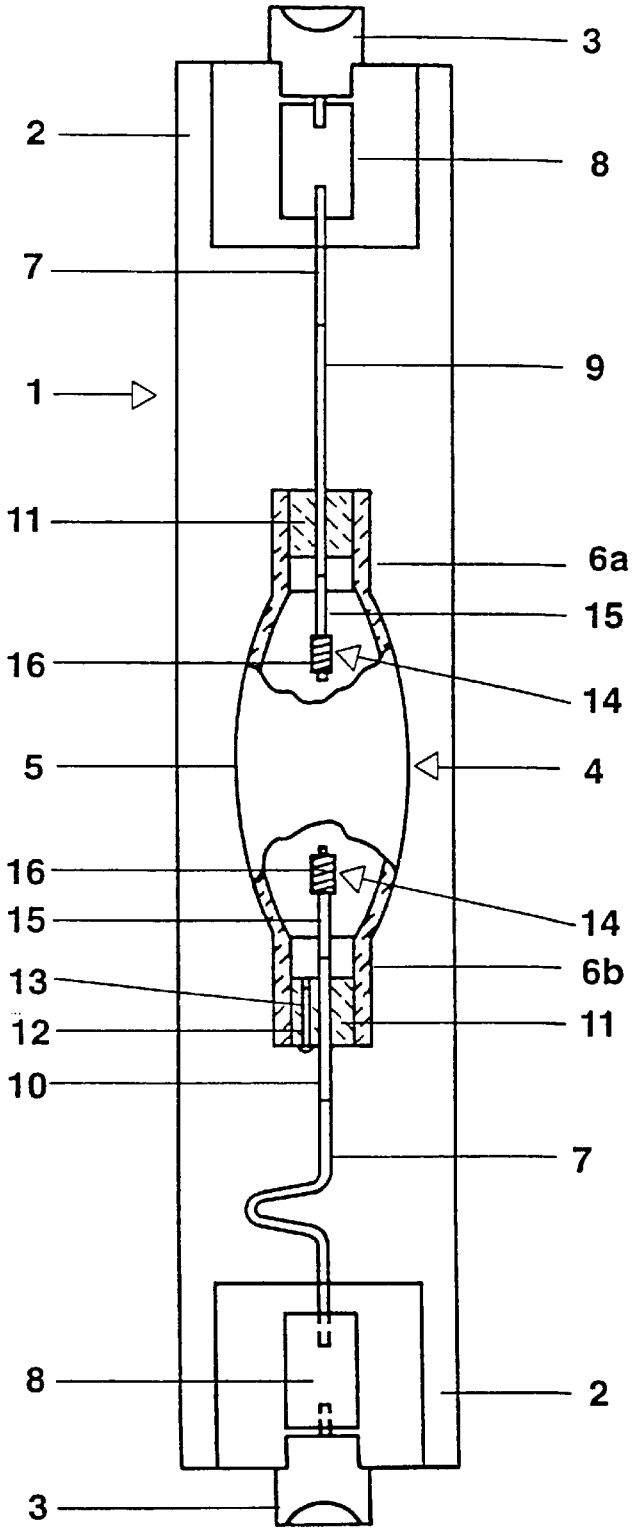
FIG. 1 shows a metal halide lamp with a ceramic discharge vessel.

A metal halide lamp having a power of 70 W is represented diagrammatically in FIG. 1. It comprises a cylindrical outer bulb 1 which is made from silica glass, defines a lamp axis and is pinched (2) and capped (3) at both ends. The axially arranged discharge vessel 4 made from $Al_2O_3$ ceramic bulges in the middle 5 and has two cylindrical ends 6*a* and 6*b*. However, it can also be cylindrical with elongated capillary tubes as plugs, as is disclosed in EP-A 587 238, for example. The discharge vessel is held in the outer bulb 1 by means of two supply leads 7 which are connected to the cap parts 3 via foils 8. The supply leads 7, of which one is a molybdenum strip for compensating the large differences in expansion, are welded to lead-throughs 9, 10 which are fitted in each case in an end plug 11 at the end of the discharge vessel.

The lead-throughs 9, 10 are molybdenum pins, for example. At the plug 11, the two lead-throughs 9, 10 project at both ends and hold electrodes 14 on the discharge side which comprise an electrode shaft 15 made from tungsten and a filament 16 pushed on at the discharge side end. The lead-through 9, 10 is butt-welded in each case to the electrode shaft 15 and to the outer supply lead 7.

The end plugs 11 consist essentially of a Cermet which is known per se and has the ceramic component of $Al_2O_3$ and the metal component of tungsten or molybdenum.

An axially parallel bore 12 which serves to evacuate and fill the discharge vessel in a way known per se is, moreover, provided in the plug 11 at the second end 6*b*. After filling, said bore 12 is sealed by means of a pin 13, denoted as a stopper in the technical jargon, or by means of a fusible ceramic.

However, it is also possible in principle to select any other known construction for the ceramic discharge vessel and for the sealing technique, see the prior art mentioned at the beginning or the documents EP-A 528 428 and EP-A 609 477, for example.

The filling of the discharge vessel comprises an inert starting gas/buffer gas, here argon with a 250 mbar cold filling pressure, and diverse additives of metal halides.

What is concerned here in detail is up to three voltage gradient generators, a suitably selected mixture as light generator and, if appropriate, further additives. In particular, TlI has proved itself in a double function as voltage gradient generator and light generator, in combination with further voltage gradient generators.

Table 2 shows some fillings, voltage gradient generators and light generators being represented separately from one another. In this case, there are light yields of between 78 and 98 lm/W in simultaneous conjunction with good colour rendition of between Ra=76 and 89. The luminous colour is in the warm white to neutral white region (3500 to 4250° K.). The voltage gradient is mostly of the order of magnitude of 60 to 120 V/cm. Surprisingly, however, even relatively low voltage gradients of between 45 and 60 V/cm still lead to good values for lighting engineering. For the purpose of comparison: the voltage gradient is between 75 and 110 V/cm for a conventional metal halide lamp with a mercury filling.

TABLE 2

| Voltage gradient generator (VGG) | Total quantity of VGG (in μmol) | Of which proportion of TlI (in μmol) | Abbreviation for light generator/ additional additive | Light yield (lm/W) | Colour rendition index Ra | Voltage gradient (in V/cm) | Ratio (total) metal:hal | Temp. (in K.) |
|---|---|---|---|---|---|---|---|---|
| InI + TlI | 10.5 | 1.4 | MHS 8-5 | 89 | 89 | 49.2 | 0.92 | 4100 |
| $MgI_2$ + TlI | 12.2 | 3.2 | MHS 8-5 | 98 | 87 | 47.8 | 0.57 | 4250 |
| $MgI_2$ + TlI + $HfBr_4$ | 8.6 | 2.2 | MHP 4 | 98 | 88 | 58.9 | 0.73 | 4280 |
| $ZnI_2$ + TlI | 7.1 | 3.9 | MHS 8-5 | 90 | 86 | 68.9 | 0.67 | 3850 |
| $AlI_3$ + TlI | 7.1 | 0.9 | MHS 8-5 | 80 | 86 | 87.4 | 0.37 | 3700 |
| $MgI_2$ + TlI | 18.1 | 1.9 | MHS 8-6 | 78 | 81 | 45.6 | 0.53 | 4250 |
| $AlI_3$ + TlI | 4.3 | 0.6 | MHS 8-1 | 81 | 77 | 58.9 | 0.46 | 3500 |
| $HfBr_4$ + TlI | 5.6 | 0.6 | MHS 8-6 | 82 | 76 | 69.4 | 0.34 | 3650 |
| InBr + TlI | 13.5 | 3.2 | MHS 8-5 | 92 | 87 | 49.3 | 0.97 | 4020 |
| InBr + TlI + $HfBr_4$ | 8.8 | 2.2 | MHP 4 | 93 | 89 | 68.9 | 0.67 | 4120 |
| $AlBr_3$ | 4.5 | 0 | MHS 8-41 | 90 | 84 | 95.0 | 0.34 | 4200 |
| $AlBr_3$ + TlI | 8.7 | 4.2 | MHS 8-5 | 88 | 81 | 94.5 | 0.49 | 3750 |
| $AlBr_3$ + TlI | 10.7 | 3.2 | MHS 8-5 | 83 | 80 | 120.0 | 0.42 | 3900 |
| Hg + TlI | 15.2 | 3.2 | MHS 8-5 | 106 | 86 | 106.7 | 3.91 | 4650 |
| Hg + TlI | 13.8 | 1.9 | MHS 8-6 | 101 | 78 | 75.6 | 4.84 | 3400 |

For the purpose of comparison, the last two rows of Table 2 also specify two conventional metal halide lamps with a filling containing mercury.

As light generators, recourse is made to the metal halide mixtures shown in Table 3, consideration also being given to CsI as additional additive of the first type. Particularly suitable as light generator is a three-component mixture consisting of thallium as first component, sodium and/or cerium as second component and at least one rare earth metal as third component.

Figure 2:
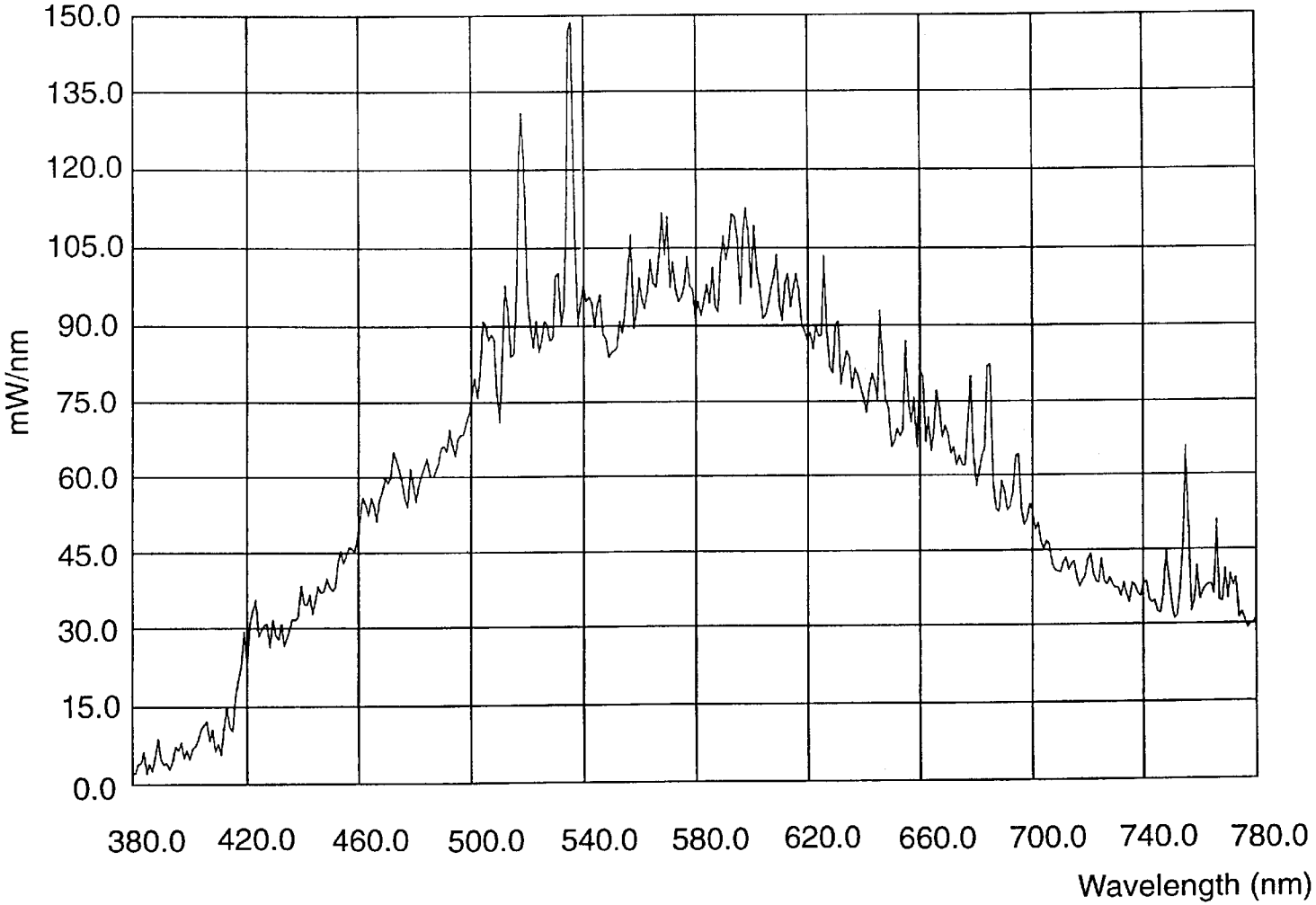
FIG. 2 shows a spectrum of a metal halide lamp.

The spectrum of a lamp with a filling in accordance with row 2 of Table 2 is shown in FIG. 2. Said filling is based on $MgI_2$ and TlI as voltage gradient generator.

TABLE 3

| Abbreviation for light generator/ additive (Total = 100%) | Proportion of TlI TlI (Mol %) | Pure light generators NaI (Mol %) | $TmI_3$ (Mol %) | $DyI_3$ (Mol %) | $HoI_3$ (Mol %) | $CeI_3$ (Mol %) | Additional additive CsI (Mol %) |
|---|---|---|---|---|---|---|---|
| MHS 8-1 | 9 | 77 | 7 | 7 | 0 | 0 | 0 |
| MHS 8-5 | 29 | 0 | 15 | 15 | 15 | 15 | 11 |
| MHS 8-6 | 9 | 67 | 7 | 7 | 0 | 0 | 10 |
| MHS 8-41 | 0 | 0 | 23 | 23 | 26 | 28 | 0 |
| MHP 4 | 8 | 62 | 10 | 10 | 10 | 0 | 0 |

A lamp volume of 0.3 $cm^3$ was used in the case of all the fillings. The electrode spacing is 9 mm. The specific wall loading (defined as electric power/inner surface) varies between 15 and 50 $W/cm^2$. It is 25 $W/cm^2$ on average. The specific electric power density varies between 100 and 500 $W/cm^3$. It is 235 $W/cm^3$ on average.

The lamps were operated in each case on an electronic ballast with square-wave current injection in a controlled power operation with $I_{eff}$<1.8 A.

The service life of such lamps is of the order of magnitude of 3000 to 6000 hours. Fillings with halides of In or Mg have proved to be favourable for a relatively long service life. A particularly good maintenance behaviour with regard to the luminous flux is exhibited by fillings which make use of halides of Hf or Zr in small quantities as additive to a metal halide chiefly used as voltage gradient generator. The drop in light yield after 1500 hours of operating time is a few percent. FIG. 10 shows two examples. One filling (Symbol [lacuna]) based on InBr (1 mg), $HfBr_4$ (0.7 mg) and the light generator system MHP 4 (8 mg) of Table 3. The other filling (symbol Δ) is based on $MgI_2$ (1.5 mg), $HfBr_4$ (0.5 mg) and again the light generator system MHP 4 (8 mg) of Table 3.

Figure 3:
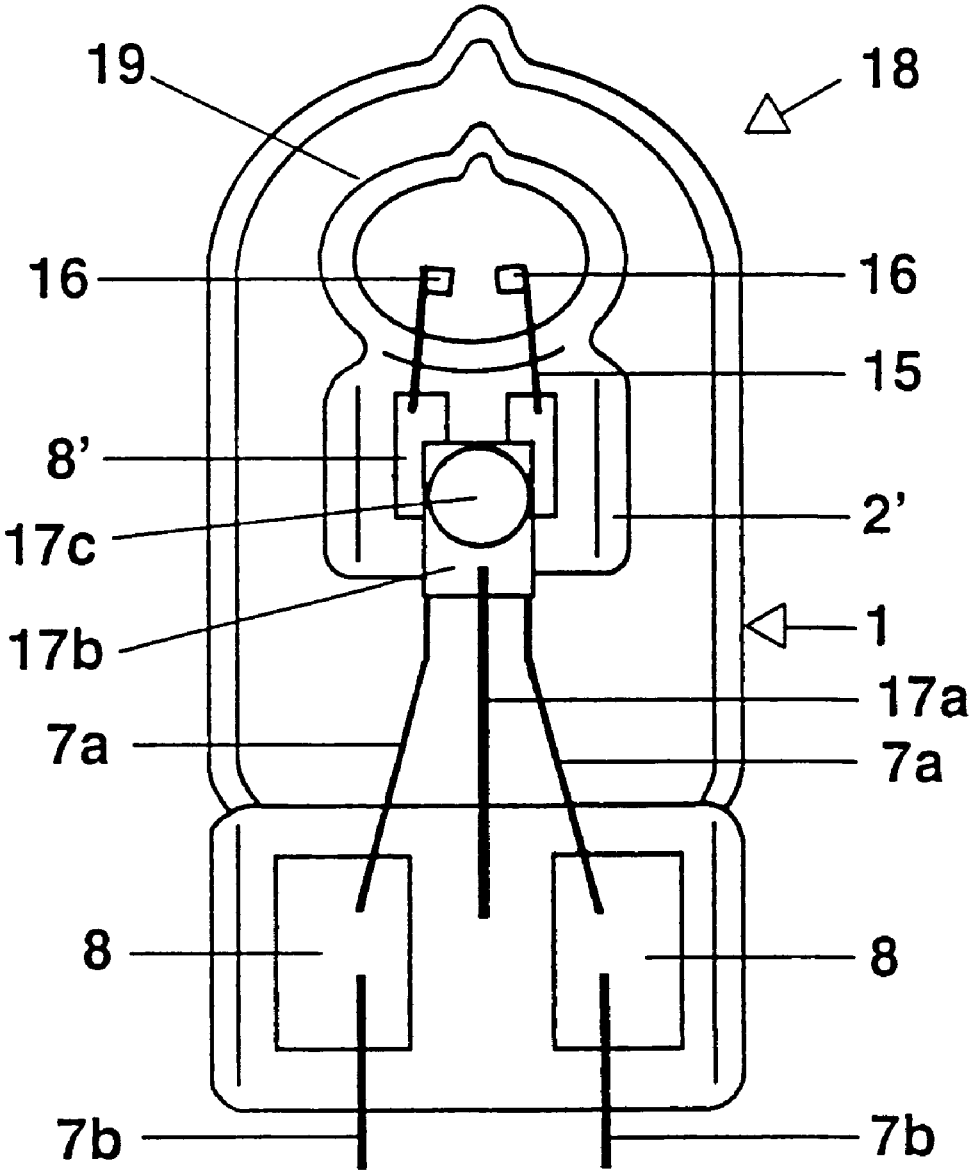
FIG. 3 shows a metal halide lamp with a discharge vessel made from silica glass.
Figure 3A:
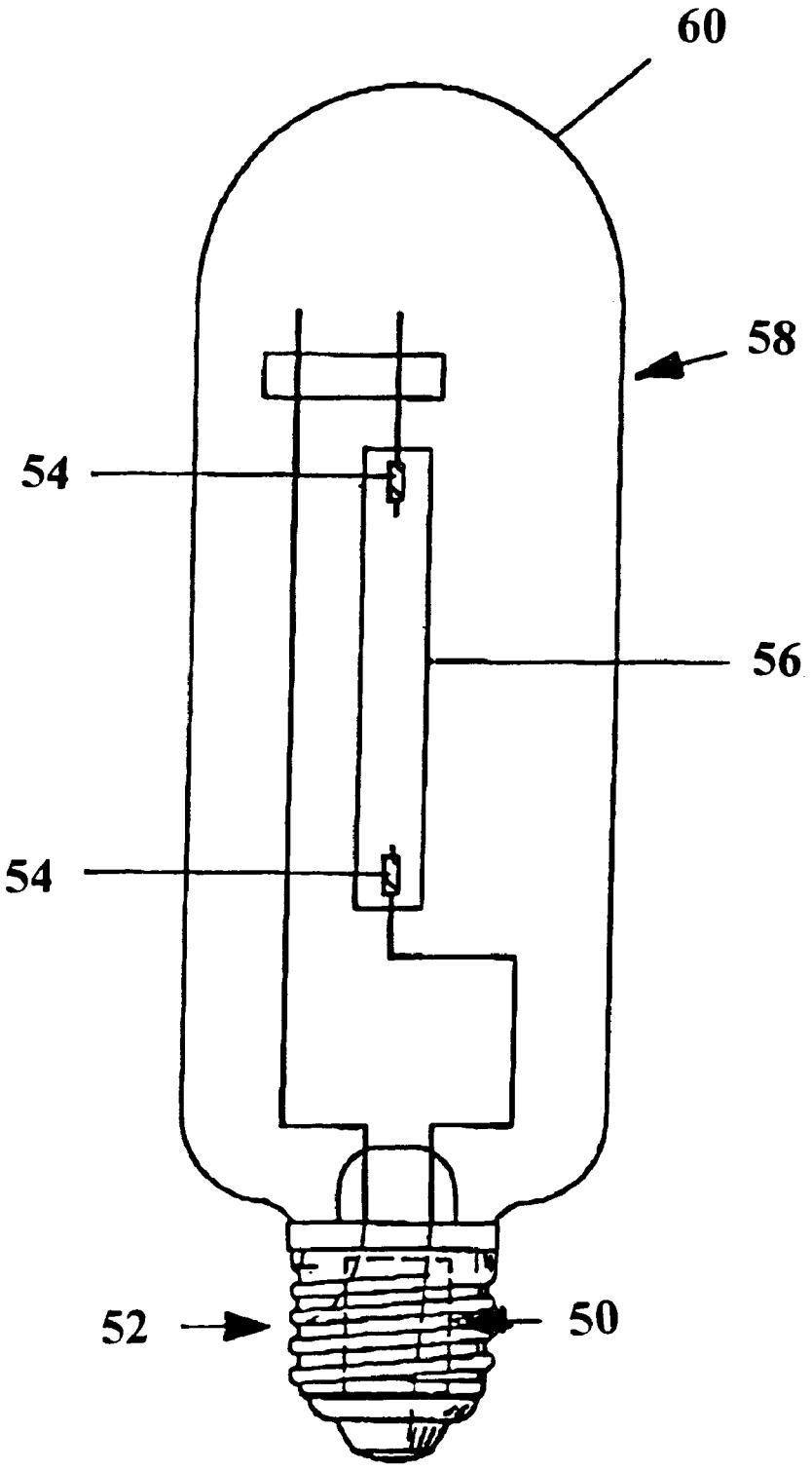

In a further exemplary embodiment (FIG. 3), the lamp is a metal halide lamp 18 having a power of 70 W, which is pinched at one end, the discharge vessel 19 also being a quartz glass bulb pinched at one end. More precise details on this are to be found, for example, in U.S. Pat. No. 4,717,852. Otherwise, identical reference numerals correspond to analogous components as in FIG. 1. Moreover, a getter 17 is accommodated in the outer bulb 1.

Inserted for this purpose was a neutral white filling based on voltage gradient generators which form readily vaporizable halides ($AlI_3$, $SnI_4$, $HfI_4$) and which resemble the voltage gradients of Hg. A Xe filling of 800 mbars was used as starting gas.

Figure 4:
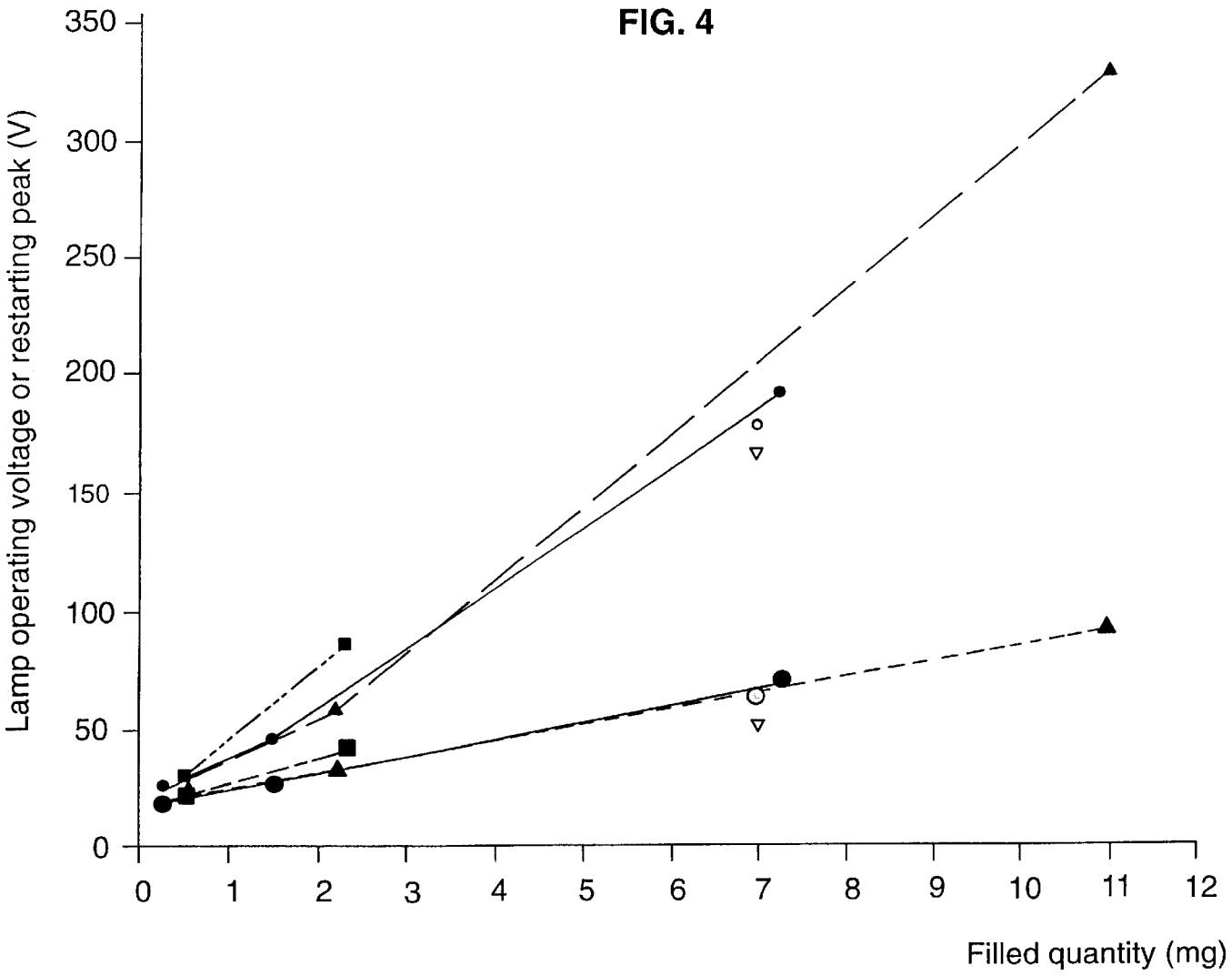
FIG. 4 shows a diagram which shows the operating voltage and restarting peak voltage as a function of the filled quantity.
Figure 5A:
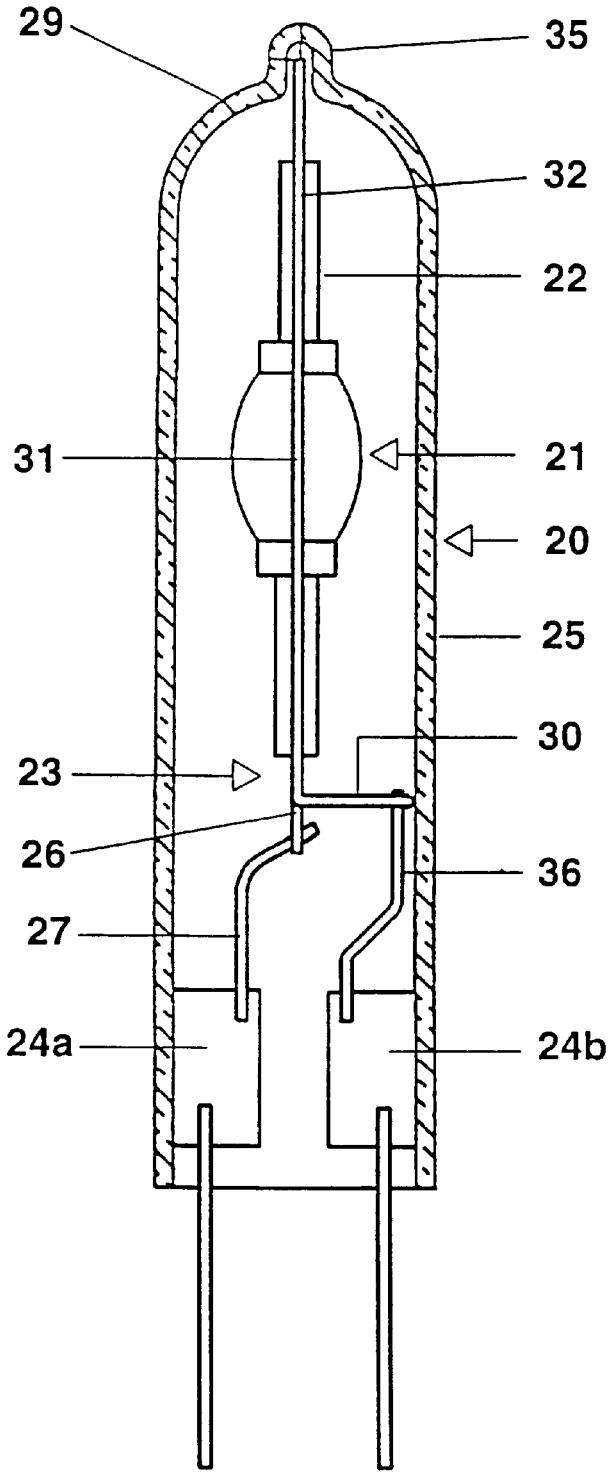
FIG. 5 shows a ceramic metal halide lamp with a special retaining frame.
Figure 5B:
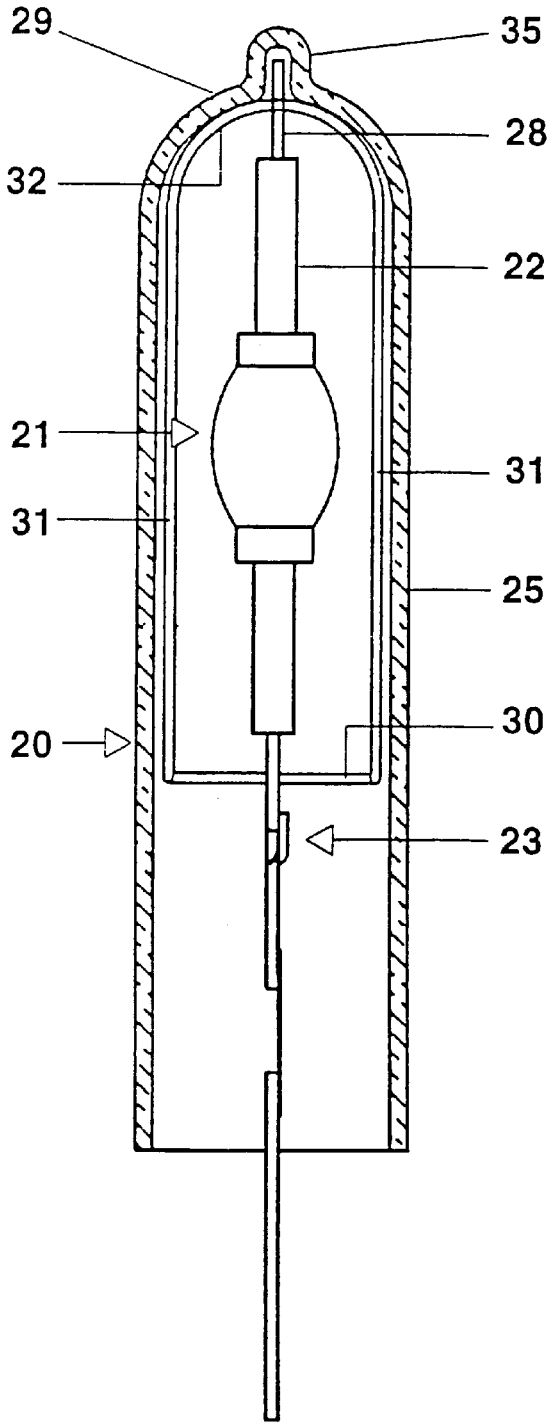
Figure 5C:
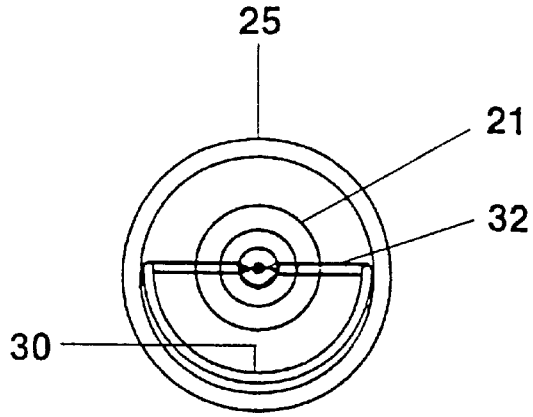
Figure 5D:
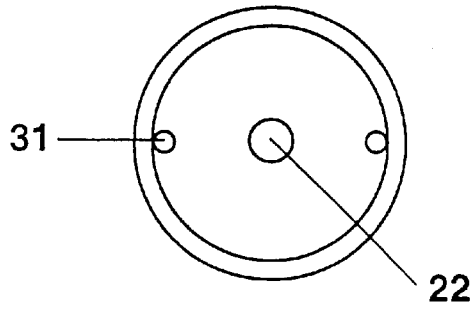

Very high restarting peaks, which also step up the root-mean-square value of the operating voltage, were present in the case of a test of the principle using CB operation. Like the operating voltage (small symbols), the level of the restarting peak (large symbols) also increases linearly with the filled quantity of the halides (compare FIG. 4).

Because of its high vapour pressure, the strongest voltage gradient is exhibited by an $HfI_4$ filling (symbolized as ■), while $AlI_3$ (symbolized as ●) and $SnI_4$ (symbolized as ▲) exhibit an approximately identical behaviour, even in the case of a different dosage quantity.

The operation of the lamps according to the invention should therefore preferably be performed using a square-wave EB in which the edges of the square-wave pulse are so steep (of the order of magnitude of approximately 10 to 50 μsec) that marked restarting peaks no longer occur. In the case of an $SnI_4$ dose (11 mg), for example, the operating voltage is then lowered from 92.8 V to 78.0 V, that is to say by 14.9 V (symbolized as a large Δ in FIG. 4). The associated restarting peak, which still had a value of 329 V in the case of CB operation, disappears virtually completely (symbolized as a small Δ in FIG. 4).

Since, after the take-over of the discharge arc the lamps initially have only an operating voltage of approximately 20 V (because no halides have yet been vaporized), the power at the CB is only approximately 25–30 W, since the inductor limits the current to somewhat more than 1 A. With this low power, the lamp remains so cold that the halides cannot vaporize, and the lamp remains stuck in the starting phase. Consequently, for the measurements on the CB the lamp current is increased to just 2 A during starting by means of a control inductor. This is sufficient for vaporizing the halides, the result then being a rise in the operating voltage, it then therefore being possible for the current to be reduced again.

A very good starting performance is realized with the aid of an electronic ballast (EB) which injects the lamp with a sufficiently high power ("constant-wattage operation"). As mentioned above—the EB also has the important advantage that it avoids the occurrence of restarting peaks.

It emerged in the course of the investigations that lamps doped with only $HfI_4$ as voltage gradient generator are particularly difficult to start and can be operated stably only with difficulty. For this reason, it is more advantageous to use $AlI_3$, $AlCl_3$ and/or $SnI_4$ as essential gradient generator.

In a further exemplary embodiment, argon with a cold filling pressure of 150 mbar was used as starting gas. Furthermore, in addition to the voltage gradient generators of $AlI_3$ and $SnI_4$, use was made as light generators of additives of $DyI_3$ and $TmI_3$ (0.27 mg in each case) and, especially, TlI (0.1 mg) and NaI (0.4 mg), in order to boost the emission in the visible spectral region. The $DyI_3$ is used as an additive to the $AlI_3$, in order to achieve better emission in the red. By contrast, the $TmI_3$ is used as an additive to the $SnI_4$, in order to increase the emission in the blue and green.

Despite dispensing with xenon, it was possible to achieve an operating voltage of 64.1 V with the system of $AlI_3/DyI_3/NaI/TlI$.

In a further exemplary embodiment, an entirely similar filling was used for a metal halide lamp having a ceramic discharge vessel. The filling consists of 5 mg $AlI_3$ as voltage gradient generator, and the light generators $DyI_3$, $TmI_3$, TlI, NaI. The ceramic discharge vessel has a volume of 0.3 $cm^3$ and an electrode spacing of 9 mm. An operating voltage of 51.2 V was achieved with a very high luminous flux of 5 klm.

The relatively low operating voltage is to be ascribed to generously vaporized NaI, because a high power density of 70 W/0.3 $cm^3$=233 $W/cm^3$ is present in the small arc tube volume.

A further exemplary embodiment of a metal halide lamp 20 according to the invention with a power of 70 W is shown in FIG. 5. FIGS. 5*a* and 5*b* respectively show side views rotated by 90°, while FIG. 5*c* shows a view from above. A section through a lamp corresponding to FIG. 5*c* is shown in FIG. 5*d*.

In detail, this is a ceramic elliptical discharge vessel 21 with elongated capillary plugs 22 at the ends. The retaining frame 23 is fastened to the foils 24*a*, 24*b* of the outer bulb 25, pinched at one end, by means of a ceramic cap of type G12. The lead-through 26 near the pinch is connected via a short angled-off supply lead 27 to one foil 24*a*. The lead-through 28 remote from the pinch is connected via a conductor system having two-fold symmetry and a short supply lead 36 to the other foil 24*b*. The conductor system comprises a semicircular arc 30 which is guided at the level of the lead-through 26 near the pinch in a plane transverse to the lamp axis on the inside of the wall of the outer bulb. Extending at the two ends of the arc 30 parallel to the lamp axis are two rods 31 mutually offset by 180° as return paths to the end of the lamp remote from the pinch. They are connected to one another via a connecting arc 32 which lies in a plane including the lamp axis and bears against the rounded end 29 of the outer bulb remote from the pinch. At the apex, the connecting arc 32 is welded to the lead-through 28 remote from the pinch. Said lead-through is anchored with its end in a channel 35 at the tip of the rounded end 29.

It is possible by using such a frame design having two-fold or higher symmetry (FIGS. 5 and 6) for magnetic influences on the discharge arc which are caused by the return paths (31; 38) to be reduced or virtually removed. This is because the deflection of the discharge arc is particularly critical in the case of a filling free from mercury. The reason for this is that the substitute substances are metal halides with a high vapour pressure, with the result that given a vertical operating position a strong deflection of the discharge arc would be caused by the magnetic effect in the case of a single, and consequently asymmetric, return path. The cause is the magnetic field generated by the return path (31; 38), which acts repulsively on the oppositely directed current in the discharge arc. This can lead to severe thermal overloading and an inhomogeneous temperature distribution at the wall of the discharge vessel and, finally, cause the latter to be destroyed. A temperature difference of more than 300° was measured.

A typical value for the current I is 1 to 2 A. The force deflecting the discharge arc is proportional to $I^2$ and to the effective length l of the return path, which corresponds to the length of the arc, and inversely proportional to the spacing r between the return path and discharge arc:

$$K \propto F(f) \times I^2 \times \frac{l}{r} \tag{1}$$

Since electrode spacing l (9 mm) and the spacing r (here approximately 7 mm) are always approximately of the same order of magnitude, the deflecting force is virtually independent of the quotient of these two variables. By contrast, the deflecting force K depends very sensitively (quadratically) on the current I. Moreover, there are also specific properties of the filling f, which are combined in equation (1) as function F(f). These include, first and foremost, the filling pressure, but also specific features of a filling component. Owing to the possibly multiply constricted ("waisted") temperature profile (seen transverse to the lamp axis) of a discharge lamp free from mercury (particularly prominent in the case of $AlI_3$, $AlBr_3$, $HfI_4$ and $HfBr_4$), this arc can be strongly influenced magnetically by contrast with an arc in the case of a mercury-containing filling. This holds chiefly for low-wattage lamps of very compact design.

In the case of the use of two or three symmetrical return paths (see FIGS. 5 and 6), on the one hand the force caused by the individual return path is substantially reduced; this is caused by the splitting of the current between a plurality of return paths. In addition, the two or, preferably, three return paths cooperate and produce overall a centring force towards the lamp axis. The discharge arc is thus stabilized in a vertical operating position onto the lamp axis.

It is advantageous for the return paths (31; 38) to be sheathed with sleeves 39 made from suitable materials (quartz stocking, ceramic tube) in a way known per se, in order to avoid photoelectric effects from UV radiation. More than four return paths (four-fold symmetry) lead, however, to a marked shading, and are therefore less suitable, particularly for reasons of cost.

It follows from the above statements that the current-carrying return paths should be of the same length as far as possible up to the point at which they meet, and should have the same spacing from the discharge arc. Owing to the approximately equal resistances of the return paths, a uniform splitting of the current, and thus a uniform magnetic field distribution is then ensured at the level of the discharge arc. Only thus can an adequate compensation of the magnetic fields in the lamp interior and a centring effect in the case of vertical operation take place. In the case of a horizontal operating position, it is advantageous in accordance with the above statements to use only a single return path. Since in the case of a horizontal operating position the discharge arc experiences a lift, the return path should be arranged above the discharge arc. It is, however, also possible to use a plurality of return paths which, however, do not need to be exactly symmetrical, so that the asymmetric lift force can be taken into account.

Figure 6:
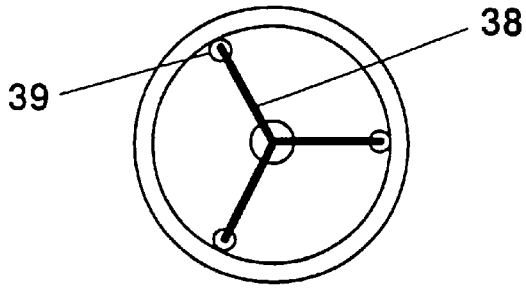
FIG. 6 shows a section through a lamp having three-fold symmetry.

A corresponding section through a lamp having three-fold symmetry is shown in FIG. 6. In accordance with equation (1), the three return paths 38 reduce the magnetic force to a ninth compared with the magnetic force of a single return path. They run together in the shape of a star towards the metal lead-through at the end of the ceramic discharge vessel remote from the cap. The return paths 38 are surrounded by ceramic sleeves 39 for screening UV radiation.

The mercury-free filling for the lamp of FIGS. 5 and 6 consists of the voltage gradient generators InBr (2 mg) and TlI, and contains the filling MHS 8–6 (5 mg) as light generator, see Table 3. In addition, 1 mg of elementary indium is added. To be specific, it has emerged that the addition of elementary metal further reduces the restarting voltage peak. The electrode spacing is 9 mm. The discharge volume is 0.3 $cm^3$. The performance of this system was investigated in detail with regard to the restarting peak.

Figure 7:
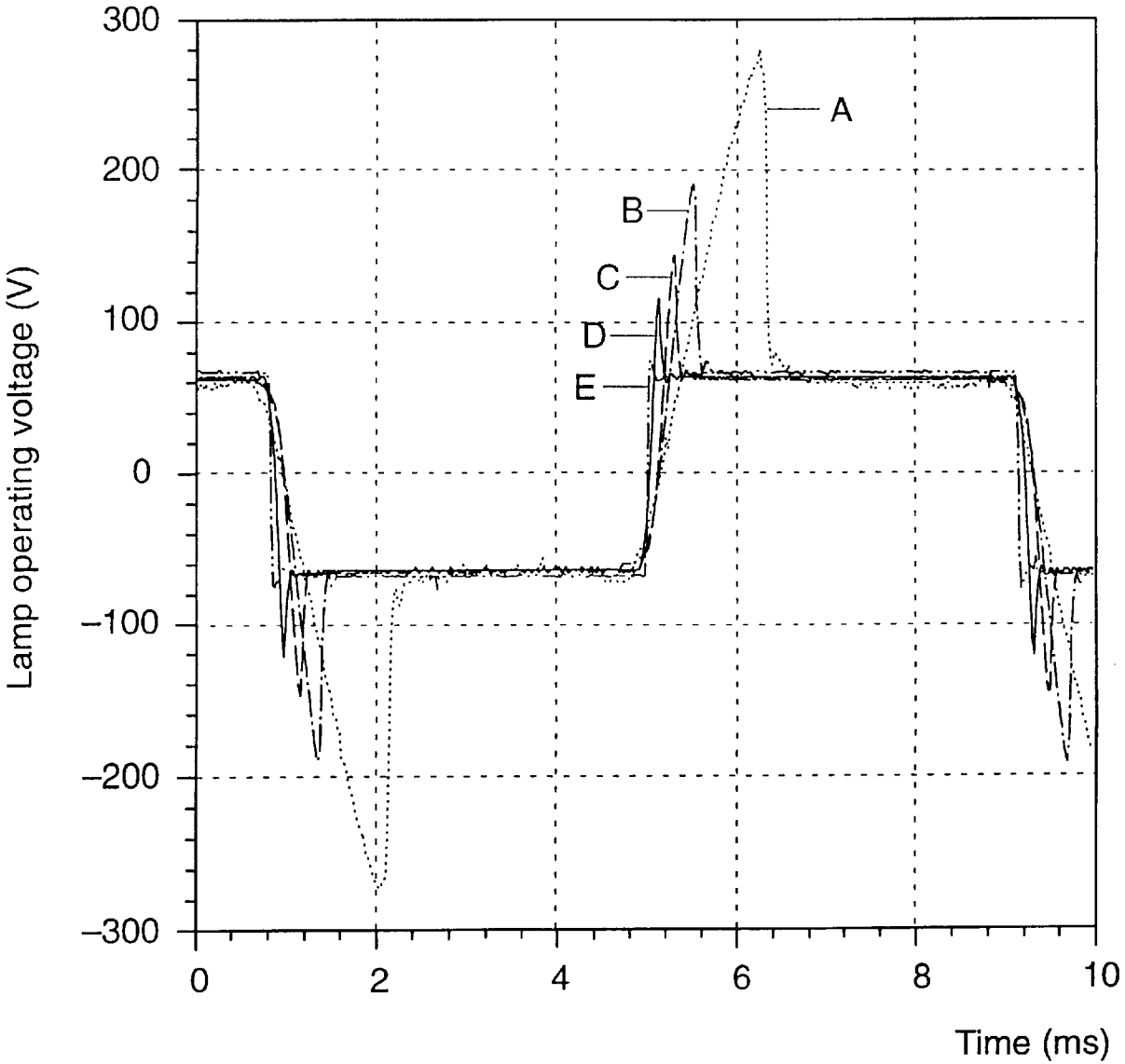
FIG. 7 shows a representation of the restarting behaviour for different edge steepnesses.

The lamp voltage (in V) is specified in FIG. 7 as a function of time (in milliseconds ms). In this case, either a sinusoidal AC voltage (curve A) or a rectangular AC voltage (curves B to E) was impressed on the lamp at a frequency of 120 Hz in each case. The amplitude of the operating voltage in the first half wave is approximately 65 V.

It can be seen that at the start of the second half wave the restarting peak to be related to the operating voltage in the first half wave of approximately −65 V as base value reaches approximately +285 V in the case of sinusoidal operation (curve A). The period for the total change in voltage of the 350 V is approximately 1400 $\mu$s, measured from the instant at which the lamp voltage rises from the operating voltage of the last half period (−65 V) serving as base value. The other half wave behaves in a fashion exactly mirror symmetrical thereto.

In the case of square-wave operation (curves B to E), the restarting peak is substantially smaller, on the one hand, and the rise time is conspicuously shorter, on the other hand. If an edge steepness is selected in accordance with a period of approximately 800 $\mu$s for the change in voltage, the restarting peak is at approximately +183 V (curve B). If the edge steepness is increased to half the period (400 $\mu$s), the restarting peak falls to +143 V (curve C). A further shortening of the period to 220 $\mu$s leads to a restarting peak of +115 V (curve D). In the case of an extremely short rise time of the edge (50 $\mu$s), the restarting peak is lowered to only +75 V (curve E) and is therefore only slightly above the base value of the subsequent square-wave pulse (with an idling operating voltage of +65 V). These values were measured electronically.

Figure 8:
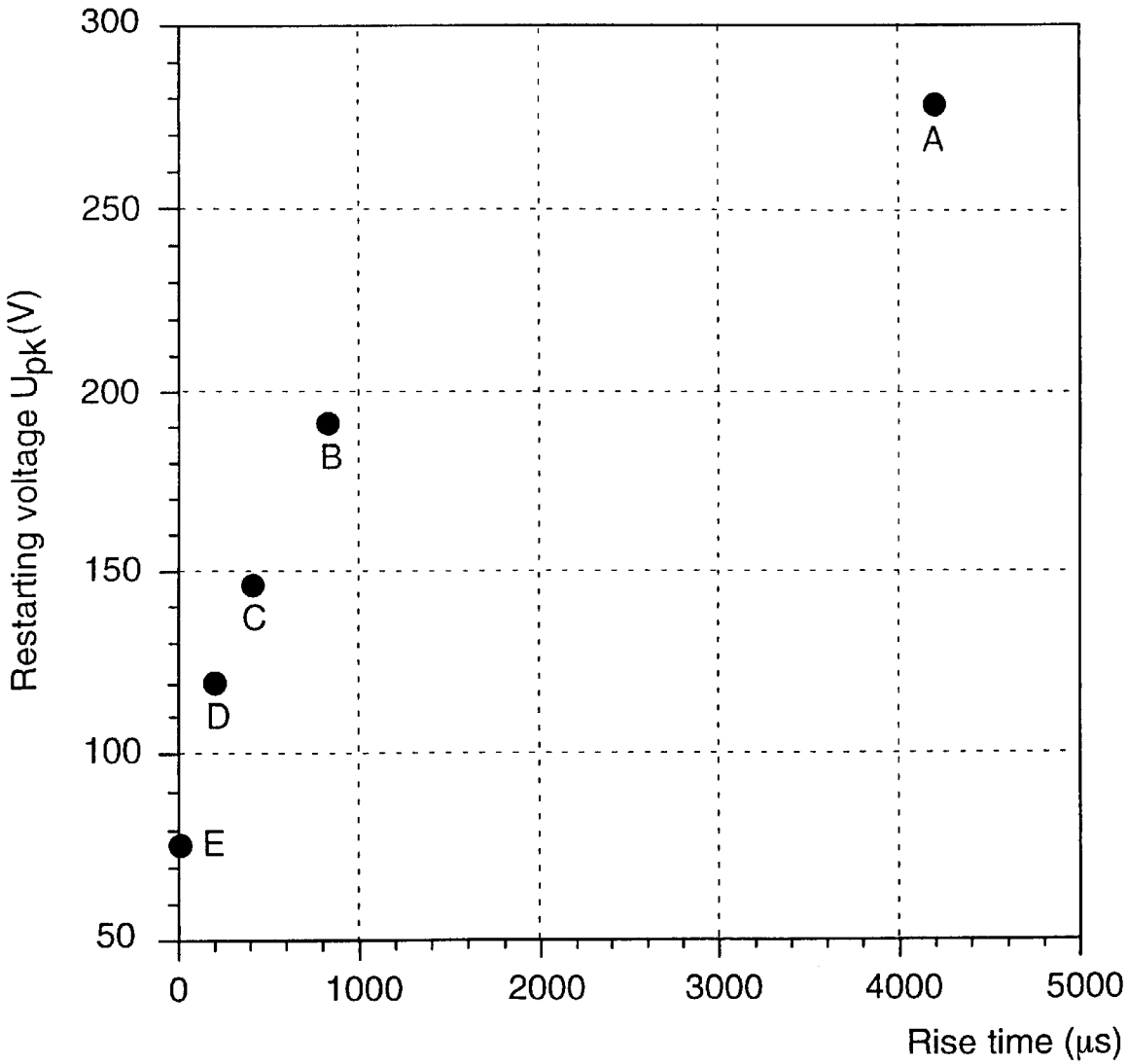
FIG. 8 shows the restarting peak voltage for the various voltage shapes from FIG. 7.

The corresponding rates of change in voltage can be calculated from FIG. 8, where the restarting peak voltage (in V) is specified as a function of the period of the change in voltage (in $\mu$s). It is to be borne in mind for calculating the rate of change in voltage that it is necessary in each case further to add the base value of the operating voltage (denoted by x) from the preceding half period (approximately −65 V) to the specified measured value of the peak voltage in the region of the restarting peak. Whereas the relationships in accordance with the curve A correspond to a rate of change in voltage of 0.25 V/$\mu$s, this value is conspicuously higher in the case of square-wave operation. It rises from 0.31 V/$\mu$s (curve B) to 0.52 V/$\mu$s (curve C, then to 0.82 V/$\mu$s (curve D). 2.8 V/$\mu$s (curve E) is achieved in the case of an extremely large edge steepness.

What is claimed is:

1. Lighting system, comprising a mercury-free metal halide lamp with a light yield of at least 75 lm/W and a colour rendition index of at least 75 and an electronic ballast which supplies AC voltage, the lamp comprising a discharge vessel into which electrodes are inserted in a vacuum-tight fashion, characterized in that the electronic ballast provides the lamp with a change in voltage during the polarity reversal at a rate of voltage change of at least 0.3 V/$\mu$s, preferably at least 1 V/$\mu$s, the filling comprising the following components:

a buffer gas which also acts as starting gas to start the lamp, a voltage gradient generator, comprising at least one metal halide which vaporizes readily and which is responsible for generating a voltage gradient of at least 45 V/cm which preferably corresponds approximately to that of mercury, and a light generator comprising at least one metal halide and/or one metal.

2. Lighting system according to claim 1, characterized in that the voltage gradient generator is a metal iodide and/or metal bromide, in particular having an operating filling pressure of at least 0.5 bar.

3. Lighting system according to claim 1, characterized in that the electronic ballast impresses a square-wave power supply voltage on the lamp.

4. Lighting system according to claim 1, characterized in that the electronic ballast keeps the power constant during operation.

5. Lighting system according to claim 1, characterized in that the starting gas is an inert gas or a mixture of inert gases with a cold filling pressure of at least 1 mbar.

6. Lighting system according to claim 1, characterized in that the voltage gradient generator is at least one halide of the following metals: Al, Bi, Hf, In, Mg, Sc, Sn, Tl, Zr, Zn, Sb, Ga except for fluoride.

7. Lighting system according to claim 1, characterized in that the light generator is at least one of the following metals or a compound of said metal, in particular a halide thereof: Na, Pr, Nd, Ce, La, Dy, Ho, Tl, Sc, Hf, Zr, Tm.

8. Lighting system according to claim 1, characterized in that the light generator is present in a quantity of between 1 and 30 mg/$cm^3$ in the discharge vessel.

9. Lighting system according to claim 1, characterized in that the filling contains elementary metals in excess which reduce the restarting peak, in particular in a quantity of between 1 and 10 mg/$cm^3$.

10. Lighting system according to claim 1, characterized in that the filling contains elementary Ta or In.

11. Lighting system according to claim 1, characterized in that the discharge vessel consists of ceramic.

12. Lighting system according to claim 1, characterized in that elementary Zn is contained as voltage gradient generator.

13. Lighting system according to claim 1, characterized in that the power of the lamp is at most 250 W.

14. Lighting system according to claim 1, characterized in that the discharge vessel is surrounded by an evacuated outer bulb.

15. Lighting system according to claim 1, characterized in that the colour temperature of the lamp is between 2800 and 4600° K.

16. Lighting system according to claim 1, characterized in that the colour temperature of the lamp is approximately 5300° K.

17. Lighting system according to claim 1, characterized in that the duration of the voltage change during a polarity reversal is so short that the restarting peak is strongly suppressed, it being the case, in particular, that said period is shorter than 1000 $\mu$s, advantageously shorter than 100 $\mu$s.

18. Lighting system according to claim 17, characterized in that the voltage change is realized in the edge of a square-wave pulse.

19. Lighting system according to claim 17, characterized in that the voltage gradient generator is present in a quantity of 1 to 200 $\mu$mol/cm$^3$ in the discharge vessel.

20. Lighting system according to claim 1, characterized in that the filling contains additional additives for improving the electric lamp properties and for influencing the temperature profile of the arc, in particular metal halides with a low excitation energy or ionization energy.

21. Lighting system according to claim 20, characterized in that the additional additives contain cesium and possibly lithium latter only for the case in which the filling has no sodium.

22. Lighting system according to claim 20, characterized in that the proportion of the additional additives is of the order of magnitude of 5 to 50 mol % compared with the proportion of the light generators.

23. Mercury-free metal halide lamp with a light yield of at least 75 lm/W and a colour rendition index of at least 75 for operating on an electronic ballast which supplies an AC voltage and provides a polarity reversal at a rate of voltage change of at least 0.3 V/$\mu$s, the lamp comprising a discharge vessel into which electrodes are inserted in a vacuum-tight fashion, characterized in that the filling comprises the following components:

- a buffer gas which also acts as starting gas to start the lamp,
- a voltage gradient generator, comprising at least one metal halide which vaporizes readily and which is responsible for generating a voltage gradient which corresponds approximately to that of mercury, and
- a light generator comprising at least one metal halide and/or one metal.

24. Metal halide lamp according to claim 23, characterized in that the discharge vessel is fastened by means of a retaining frame in an outer bulb pinched at one end, the retaining frame having a feedback supply lead with at least two-fold symmetry.

25. Mercury-free metal halide lamp, the lamp comprising a discharge vessel into which electrodes are inserted in a vacuum-tight fashion, the discharge vessel being fastened by means of a retaining frame in an outer bulb pinched at one end, characterized in that the retaining frame has a feedback conductor system made from at least three supply leads which are arranged symmetrically.

* * * * *